US007541287B2

(12) United States Patent
Schmolke et al.

(10) Patent No.: US 7,541,287 B2
(45) Date of Patent: Jun. 2, 2009

(54) METHOD FOR MACHINING A SEMICONDUCTOR WAFER ON BOTH SIDES IN A CARRIER, CARRIER, AND A SEMICONDUCTOR WAFER PRODUCED BY THE METHOD

(75) Inventors: Ruediger Schmolke, Burghausen (DE); Thomas Buschhardt, Burghausen (DE); Gerhard Heier, Burghausen (DE); Guido Wenski, Burghausen (DE)

(73) Assignee: Siltronic AG, Munich (DE)

( * ) Notice: Subject to any disclaimer, the term of this patent is extended or adjusted under 35 U.S.C. 154(b) by 225 days.

(21) Appl. No.: 11/487,652

(22) Filed: Jul. 17, 2006

(65) Prior Publication Data

US 2007/0021042 A1 Jan. 25, 2007

(30) Foreign Application Priority Data

Jul. 21, 2005 (DE) ..... 10 2005 034 119

(51) Int. Cl.
*H01L 21/302* (2006.01)

(52) U.S. Cl. ..... 438/692; 438/691; 438/959; 451/41; 451/28; 451/60; 451/63; 451/269; 451/287; 451/290

(58) Field of Classification Search ..... 438/959, 438/59, 691; 451/28, 41, 60, 63, 269, 287, 451/290

See application file for complete search history.

(56) References Cited

U.S. PATENT DOCUMENTS 6,080,048 A * 6/2000 Kotagiri et al. ..... 451/285
6,299,514 B1 10/2001 Boller
6,454,635 B1 * 9/2002 Zhang et al. ..... 451/41
6,458,688 B1 10/2002 Wenski et al.

(Continued)

FOREIGN PATENT DOCUMENTS

DE 199 05 737 A1 8/2000

(Continued)

OTHER PUBLICATIONS

Patent Abstract of Japan corresponding to JP 05-177539.

(Continued)

*Primary Examiner*—Thao X Le
*Assistant Examiner*—Eric W Jones
(74) *Attorney, Agent, or Firm*—Brooks Kushman P.C.

(57) ABSTRACT

A semiconductor wafer is guided in a cutout in a carrier while a thickness of the semiconductor wafer is reduced to a target thickness by material removal from the front and back surfaces simultaneously. The semiconductor wafer is machined until it is thinner than a carrier body and thicker than an inlay used to line the cutout in the carrier to protect the semiconductor wafer. The carrier is distinguished by the fact that the carrier body and the inlay have different thicknesses throughout the entire duration of the machining of the semiconductor wafer, the carrier body being thicker than the inlay, by from 20 to 70 μm. Themethod provides semiconductor wafers polished on both sides, having a front surface, a back surface and an edge, and a local flatness of the front surface, $SFQR_{max}$ of less than 50 nm with an edge exclusion of R-2 mm and less than nm with an edge exclusion of R-1 mm, based on a site area of 26 by 8 mm.

6 Claims, 2 Drawing Sheets

U.S. PATENT DOCUMENTS

| | | | | |
|---|---|---|---|---|
| 6,793,837 | B2 * | 9/2004 | Wenski et al. | 216/88 |
| 2001/0047978 | A1 * | 12/2001 | Wenski et al. | 216/2 |
| 2002/0077039 | A1 * | 6/2002 | Wenski et al. | 451/41 |
| 2002/0115387 | A1 * | 8/2002 | Wenski et al. | 451/41 |
| 2002/0187639 | A1 * | 12/2002 | Hennhofer et al. | 438/691 |
| 2003/0045089 | A1 * | 3/2003 | Wenski et al. | 438/626 |
| 2003/0054650 | A1 * | 3/2003 | Wenski et al. | 438/692 |
| 2004/0235402 | A1 | 11/2004 | Bjelopavlic et al. | |
| 2005/0124264 | A1 * | 6/2005 | Tominaga et al. | 451/41 |
| 2008/0318493 | A1 * | 12/2008 | Aida | 451/36 |

FOREIGN PATENT DOCUMENTS

| | | | |
|---|---|---|---|
| DE | 100 07 390 | A1 | 10/2000 |
| DE | 102 10 023 | A1 | 5/2003 |
| DE | 102 50 823 | B4 | 2/2005 |
| EP | 0 197 214 | A2 | 10/1986 |
| EP | 0 776 030 | A2 | 5/1997 |
| EP | 0 887 152 | A2 | 12/1998 |
| JP | 1997-150366 | A | 6/1997 |
| KR | 10-2005-0055531 | | 6/2005 |

OTHER PUBLICATIONS

English Derwent Abstract AN 2004-392663 corresponding to DE 102 50 823 B4.

English Derwent Abstract AN 2003-459230 corresponding to DE 102 10 023 A1.

* cited by examiner

METHOD FOR MACHINING A SEMICONDUCTOR WAFER ON BOTH SIDES IN A CARRIER, CARRIER, AND A SEMICONDUCTOR WAFER PRODUCED BY THE METHOD

BACKGROUND OF THE INVENTION

1. Field of the Invention

The invention relates to a method for machining a semiconductor wafer which is guided in a cutout in a carrier while a thickness of the semiconductor wafer is being reduced to a target thickness by material being removed from a front surface and a back surface of the semiconductor wafer simultaneously. A method of this type is used in particular for the double side polishing and lapping of semiconductor wafers. A carrier is used to hold and guide at least one semiconductor wafer during machining. To protect the semiconductor wafer, the cutout of the carrier in which the semiconductor wafer lies during machining is lined with an inlay. A carrier of this type is formed by a carrier body and the at least one inlay.

2. Background Art

According to U.S. Pat. No. 6,454,635, during machining the semiconductor wafer acquires a bead-like thickened portion in the edge region when the thickness of the inlay, as a result of wear, becomes less than the thickness of the carrier body. US-2004/0235401 includes the description of a carrier, the inlay of which is at least 20 μm thicker than the thickness of the carrier body. This is intended to prevent wear to the carrier body from releasing metals during the machining of the semiconductor wafer, which would contaminate the semiconductor wafer.

JP-05-177539 A proposes a method for the double side polishing of semiconductor wafers, according to which the thickness t of the semiconductor wafer to be machined, the thickness T of the carrier and the depth of penetration x of the semiconductor wafer into the polishing cloth are matched to one another according to the inequality $T-2x<t<T+2x$. The method can be used, inter alia, to produce semiconductor wafers which are concave in cross section and in which a particularly flat front surface can be generated by subsequent single side polishing.

It is desirable for the demands imposed on the flatness of the front surface of a semiconductor wafer as far as possible also to be satisfied in the edge region of the semiconductor wafer, so that this region can also be used to construct electronic components.

The local flatness on the front surface of a semiconductor wafer is generally specified by the SFQRmax value. For this purpose, the area of the front surface is divided into sites, taking into account an edge exclusion, and the positive and negative deviation from a reference plane is determined, the reference plane being determined for each site by error square minimization. The SFQRmax value (Site Frontside Site-Least-Squares Range) indicates the deviation which is not exceeded in 100% of the sites.

SUMMARY OF THE INVENTION

It is an object of the present invention to specify a method which in technical terms is relatively simple and which provides semiconductor wafers with a local flatness of the front surface, even in the edge region, which satisfies the demands imposed on this parameter for the fabrication of current and future generations of electronic components. These and other objects are achieved by a method for machining a semiconductor wafer which is guided in a cutout in a carrier while a thickness of the semiconductor wafer is being reduced to a target thickness by material being removed from a front surface and a back surface of the semiconductor wafer simultaneously, wherein the semiconductor wafer is machined until it is thinner than a carrier body and thicker than an inlay used to line the cutout in the carrier to protect the semiconductor wafer.

DETAILED DESCRIPTION OF THE PREFERRED EMBODIMENT(S)

Figure 1:
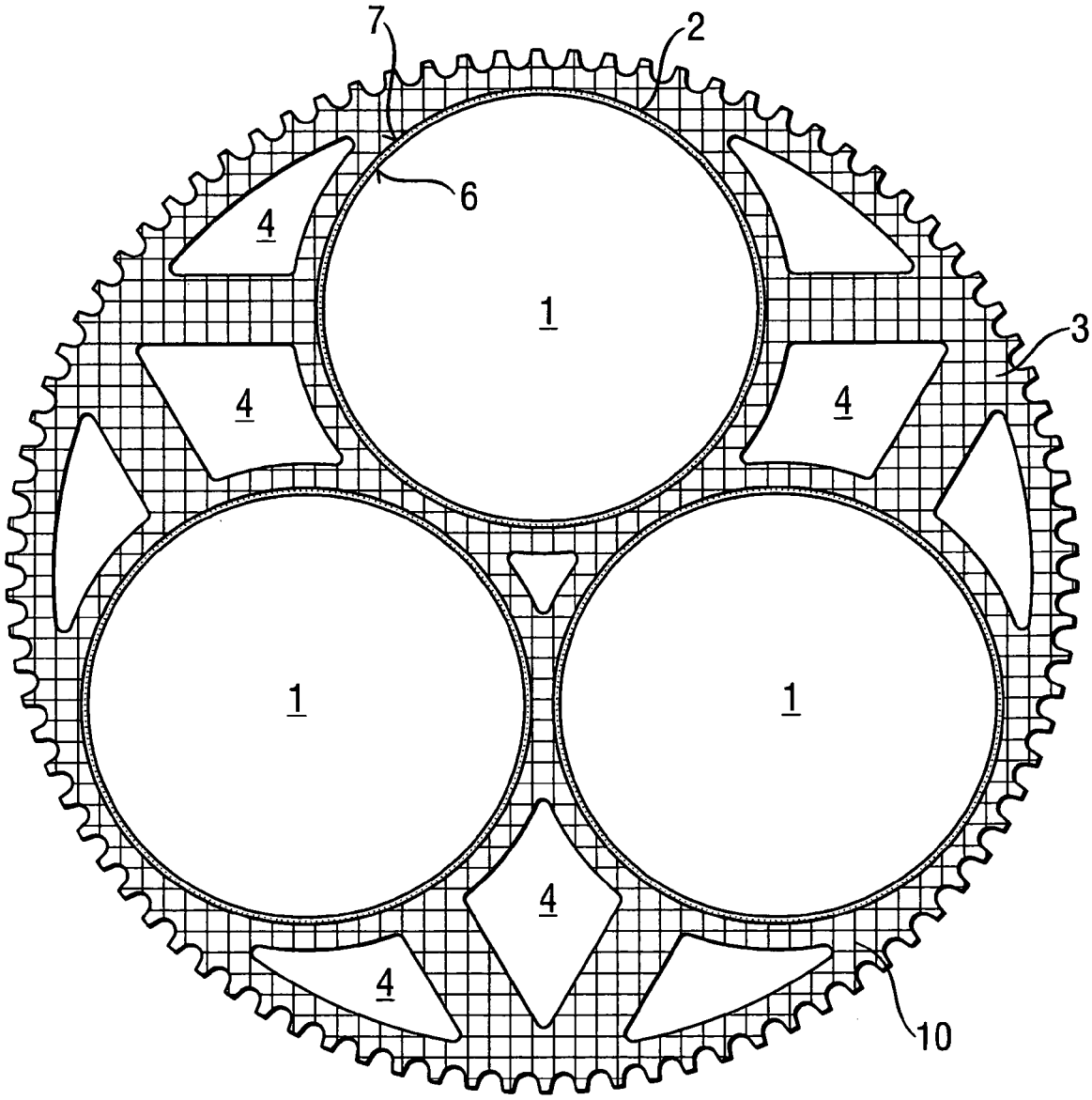
FIG. 1 shows a plan view of a typical carrier with cutouts for holding three semiconductor wafers.

The primary application area of the invention is the double side polishing of semiconductor wafers, in particular of wafers which partially or completely consist of silicon. The invention also relates to a semiconductor wafer which has been polished on both sides and has a front surface, a back surface and an edge R as well as a local flatness on the front surface, expressed as $SFQR_{max}$, of less than 50 nm with an edge exclusion of R-2 mm and of less than 115 nm with an edge exclusion of R-1 mm, these details being based on a grid with a site area of 26 by 8 mm.

Semiconductor wafers with a diameter of at least 200 mm, the local flatness $SFQR_{max}$ of which has flatness values as far as the edge region as previously indicated, were hitherto not feasible. Surprisingly, this is now achievable by carrying out the double side polishing in accordance with the method described above. Unlike known methods, the semiconductor wafer is positioned in a carrier, which likewise forms part of the invention, wherein the carrier body and the inlay have different thicknesses throughout the entire duration of the machining of the semiconductor wafer and the carrier body is thicker than the inlay, with the thickness difference amounting to 20 to 70 μm.

The invention is based on the discovery that two conditions need to be satisfied simultaneously in order to be able to achieve an excellent local flatness even in the edge region of the front surface of the semiconductor wafer. Firstly, the machining of the semiconductor wafer on both sides must lead to the machined wafer being thinner than the carrier body. The thickness difference (target thickness of the semiconductor wafer—thickness of the carrier body) is preferably in the range from <0 to −6 μm, preferably in the range from −1 to −5 μm. Secondly, an inlay which is thinner than the carrier body must be present between the semiconductor wafer and the carrier body. This second requirement is particularly surprising since this is considered disadvantageous by the above-mentioned U.S. Pat. No. 6,454,635. The thickness difference (thickness of the carrier body—thickness of the inlay) amounts to 20 to 70 μm, more preferably 30 to 60 μm.

Further details of the invention are described below based on the example of the double side polishing of silicon semiconductor wafers with a diameter of 300 mm and with reference to the figures.

The invention can be carried out on existing installations and using existing methods for the double side polishing of semiconductor wafers. The installation may be designed for one or more carriers. On account of the increased throughput, an installation for a plurality of carriers is preferred, as described for example in DE-100 07 390 A1, and in which the carriers move on a planetary orbit around the center of the installation. The installation includes lower and upper polishing plates, which can rotate freely in the horizontal plane and are covered with polishing cloth. During the polishing, the semiconductor wafers are located in the cutouts in the carriers and between the two polishing plates, which are rotating and exert a certain polishing pressure on them while a polishing abrasive is supplied continuously. The carriers are thereby also set in motion, preferably via rotating pinned wheels which engage in teeth on the circumference of the carriers.

FIG. 1 shows a plan view of a typical carrier with cutouts 1 for holding three semiconductor wafers. At the circumference of the cutouts are inlays 2 which are intended to protect the edges of the semiconductor wafers, which are susceptible to breaking, in particular also from release of metals from the carrier body 3. The carrier body 3 may, for example, consist of metal, ceramic, plastic, fiber-reinforced plastic or metal which has been coated with plastic or with a diamond-like carbon layer (DLC layer). However, it is preferable to use steel, most preferably stainless chromium steel. The cutouts 1are preferably designed to hold an odd number of semiconductor wafers with a diameter of at least 200 mm, preferably 300 mm, and thicknesses of from 500 to 1000 μm.

It is also preferable for the surface of the carrier body 3 to be structured on the front surface, the back surface or both surfaces of the carrier body, in order to promote the distribution of the polishing abrasive between the carrier body, the semiconductor wafer and the upper and lower polishing cloths. Instead of or in addition to the openings 4 shown in FIG. 1, the surface of the carrier body (front surface and/or back surface) can be provided with structures 10 which are arranged in the form of a pattern of orthogonal trenches (XY-pattern), a rhomboid pattern, a strip pattern, a pattern of radially diverging rays or an alternative pattern. The depth of the structures 10 is preferably in a range from 1 to 200 μm, with the range from 20 to 100 μm being particularly preferred. The width of the structures is preferably in a range from 0.2 mm to 10 mm, with the range from 2 to 5 mm being particularly preferred.

The inlays 2 preferably consist of a plastic, such as polyvinyl chloride (PVC), polyethylene (PE), polypropylene (PP), polyamide (PA), polystyrene (PS), polyvinylidene difluoride (PVDF), aramid or other polymers derived from fluorohydrocarbons. It is particularly preferable to use PA, aramid and PVDF. The inlays should be regularly replaced, in particular when they have been worn down to a certain level. They can be fixedly or releasably connected to the carrier body and for this purpose can, for example, be laid, adhesively bonded or injection-molded into the cutouts. It is also advantageous for the inlays to be regularly cleaned using a cloth.

The polishing plates of modern installations have a sufficient area for it to be possible for three or more, preferably five carriers to be placed on them. The thickness of the carrier body and the thicknesses of the group of carrier bodies used in one polishing run should be as uniform as possible. Therefore, the thickness variation of the carrier body measured for example with the aid of a sensor carrying out a measurement at 13 points is preferably not greater than 5 μm, more preferably no greater than 2.5 μm. Within a group of carriers, the mean thickness, formed from 13 measurement points of the carrier bodies, should preferably vary by no more than 3 μm, more preferably by no more than 2 μm.

Figure 2:
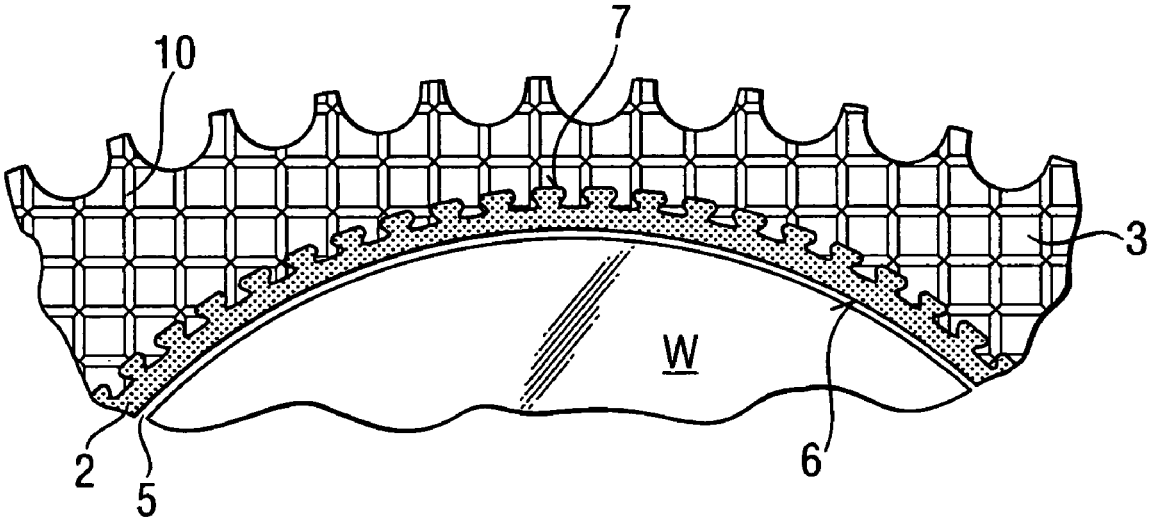
FIG. 2 shows an enlarged detail illustrating the relative positions of semiconductor wafer, inlay and carrier body.

As can be seen from FIG. 2, between the semiconductor wafer W and an adjacent inner edge of the inlay 2 there is a gap 5 which allows the semiconductor wafer W to move freely within the cutout 1 and is preferably 0.1 to 2 mm, more preferably 0.5 to 1 mm wide. The radial width of the inlay 2, measured from the inner edge 6 to the outer edge 7, is preferably 2 to 10 mm, more preferably 2 to 4 mm. It is also preferable for the carrier body, for the purposes of improved bonding of the inlay, to be profiled at the circumference of the cutout, more preferably with a dovetail profile. To produce the inlay, by way of example, plastic is injected into a shaping mold, which is preferably designed in such a manner that the plastic completely fills the spaces predetermined by the profile and forms a smooth inner edge 6 which protects the semiconductor wafer, which is susceptible to breaking, during polishing, and also ensures that it is not pulled in between the carrier body 3 and one of the polishing plates.

Figure 3:
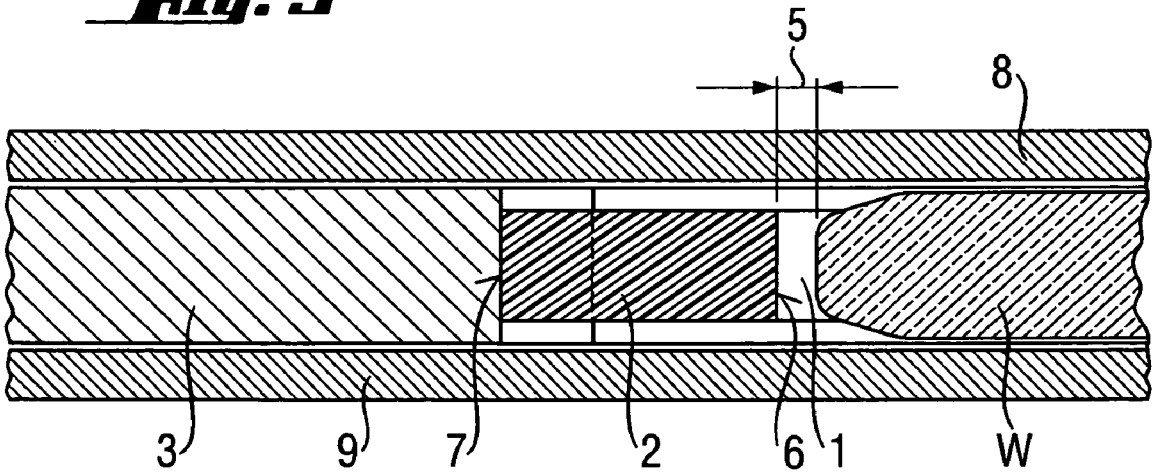
FIG. 3 shows a cross section through the arrangement of carrier body, inlay and semiconductor wafer between two polishing plates.

FIG. 3 illustrates the feature required for the invention to succeed, whereby the carrier body 3 is thicker than the inlay 2, the thickness difference amounting to 20 to 70 μm, more preferably 30 to 60 m. It is also preferable for the inlay 2 to be arranged centrally, resulting in equal distances from the upper and lower polishing plates (8, 9). It is, however, also possible to deviate from this arrangement, in particular if the alternative arrangement brings about advantages, as may occur for example when polishing semiconductor wafers with an asymmetric edge profile. FIG. 3 shows the situation in which the semiconductor wafer W has been polished to the target thickness and the polishing is ending. According to the invention, the semiconductor wafer W is polished to a target thickness which is less than the thickness of the carrier body 3 and greater than the thickness of the inlay 2. The thickness difference (target thickness of the semiconductor wafer—thickness of the carrier body) is preferably less than 0 to −6 μm, more preferably from −1 to −5 μm.

The success of the invention will become clear from the comparison with the prior art presented below.

The comparative examples (C) and examples (E) relate to the double side polishing of silicon wafers with a diameter of 300 mm and a starting thickness of 800 to 805 μm on an installation of Type AC 2000 produced by Peter Wolters (Rendsburg).

The silicon wafers were produced in accordance with the prior art by wire sawing of a single crystal, edge rounding, surface grinding, etching in a concentrated mixture of nitric acid and hydrofluoric acid and edge polishing.

A commercially available polyurethane polishing cloth reinforced with polyethylene fibers, having a Shore hardness A of approx. 80, and a polishing fluid with an $SiO_2$ solids content of 4% by weight and a pH of 11 were used for the double side polishing. The contact pressure of the polishing plate was 0.15 bar and the temperature was 38° C. The front surface of the silicon wafer was in this case facing toward the lower polishing plate.

Three groups of carriers (Types 1 to 3) were available for the polishing. The carrier bodies of all three types of carrier were made from stainless chromium steel and had a polished surface, the set of carriers of type 3 additionally being coated with DLC. The carrier bodies each had three circular cutouts arranged at regular intervals on a circular path and lined with plastic inlays.

The local flatness of the front surface of the polished semiconductor wafers was determined using an AFS 3220 produced by ADE.

As can be seen from Table 1, only the carriers of Type 2 and 3 were designed in accordance with the invention. In the case of the carriers of Type 1, the thickness difference (thickness of the carrier body—thickness of the inlay) was in a range which lies outside that covered by the invention. The local flatness of the front surface was in the required range of SFQRmax less than 50 nm only in the case of semiconductor wafers produced in accordance with the invention. Furthermore, a back surface referenced global flatness, expressed as GBIR (Global Backside Ideal Range) of these semiconductor wafers was measured using a measurement appliance of Type AFS 3220 produced by ADE. It was less than 0.800 μm both at an edge exclusion of R-2 mm and at an edge exclusion of R-1 mm.

TABLE 1

| | Type | $d_{LSK}$ [μm] | $d_E$ [μm] | $d_{LSK} - d_E$ [μm] | $d_Z - d_{LSK}$ [μm] | $SFQR_{max}^2$ [nm] | $SFQR_{max}^1$ [nm] | GBIR [μm] |
|---|---|---|---|---|---|---|---|---|
| C1 | 1 | 769 | 770 | −1 | −1.7 | 83 | 101 | 1.03 ± 0.13 |
| C2 | 1 | 769 | 768 | 1 | −1.1 | 63 | 82 | 0.75 ± 0.06 |
| C3 | 1 | 769 | 768 | 1 | +3.8 | 50 | 72 | 0.52 ± 0.03 |
| E1 | 2 | 769 | 717 | 52 | −3.0 | 42 | 82 | 0.75 ± 0.06 |
| E2 | 2 | 769 | 717 | 52 | −2.1 | 44 | 72 | 0.51 ± 0.06 |
| E3 | 2 | 769 | 717 | 52 | −0.1 | 48 | 103 | 0.35 ± 0.03 |
| C4 | 2 | 769 | 717 | 52 | +3.3 | 58 | 146 | 0.38 ± 0.03 |
| E4 | 3 | 773 | 724 | 49 | −4.8 | 45 | 114 | 0.77 ± 0.04 |
| E5 | 3 | 773 | 724 | 49 | −4.0 | 42 | 112 | 0.57 ± 0.02 |
| C5 | 3 | 773 | 730 | 43 | −7.0 | 57 | — | 0.80 ± 0.04 |
| C6 | 3 | 773 | 730 | 43 | −8.0 | 61 | — | 0.73 ± 0.03 |

The GBIR values are identical for an edge exclusion of 1 mm and 2 mm.

The abbreviations used in the table have the following meanings:

$d_{LSK}$: thickness of the carrier body $d_E$: thickness of the inlay $d_z$: target thickness of the silicon wafer $SFQR_{max}^2$: local flatness at an edge exclusion of 2 mm, 336 sites (full and partial sites) and a site area of 26 by 8 mm;

$SFQR_{max}^1$: local flatness at an edge exclusion of 1 mm, 342 sites (full and partial sites) and a site area of 26 by 8 mm;

GBIR (Global Backside Ideal Range): global flatness at an edge exclusion of 2 mm.

In addition to the local and global flatness, the geometry in the edge region of the semiconductor wafers was also examined. This was done using the measurement appliance NP1 300 mm produced by KLA Tencor. In this measurement method, 360 radial cross sections are calculated from the center of the silicon wafers at intervals of 1°. The radial cross sections are then divided into 4 sectors, and the mean of the 90 radial cross sections per sector is determined. Thereafter, a third order reference line is calculated for each sector for the range R-5 mm to R-35 mm. The deviations between the mean radial cross section and the reference line are determined at positions R-3 mm, R-2 mm, R-1 mm.

The deviations from the reference line can be indicated with respect to the front surface (measurement of the front surface), with respect to the back surface (measurement of the back surface) or with respect to the sum of the deviations with respect to the front surface and the back surface (thickness measurement). In the measurement, deviations with a positive sign indicate an edge roll-up, while deviations with a negative sign indicate an edge roll-off.

The deviations in the mean cross section measured at R-2 mm from the reference curve (thickness measurement) were within a range of −0.040 μm to −0.003 μm. In the case of the front surface, the deviations at R-2 mm were in the range from −0.030 μm to 0.050 μm. For the measurement of the back surface, the deviations at R-2 mm were in the range from −0.070 μm to 0.030 μm.

The deviations between the mean cross section measured at R-1 mm and the reference curve (thickness measurement) were within a range from −0.020 μm to −0.070 μm. For the front surface, the deviations at R-1 mm were in the range from −0.050 μm to 0.040 μm. For the back surface measurement, the deviations at R-1 mm were in the range from −0.080 μm to 0.030 μm.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method for machining a semiconductor wafer to a target thickness, comprising guiding the semiconductor wafer in a cutout of a carrier and reducing a thickness of the semiconductor wafer to a target thickness by removing material from a front surface and a back surface of the semiconductor wafer simultaneously, and machining the semiconductor wafer until it is thinner than the carrier and thicker than an inlay which lines the cutout in the carrier to protect the semiconductor wafer and which is thinner than the carrier, wherein the difference between the thickness of the carrier and the thickness of the inlay is in the range of 20 to 70 μm, and wherein the difference Δh between the target thickness of the semiconductor wafer and the thickness of the carrier body is $-6\ \mu m \leqq \Delta h < 0\ \mu m$.

2. The method of claim 1, wherein the semiconductor wafer is machined until material with a thickness of at least 5 μm has been removed.

3. The method of claim 2, wherein the difference between the thickness of the carrier and the thickness of the inlay is between 30 μm and 60 μm.

4. The method of claim 1, wherein the difference Δh between the target thickness of the semiconductor wafer and the thickness of the carrier body is $-5\ \mu m \leqq \Delta h \leqq -1\ \mu m$.

5. The method of claim 4, wherein the semiconductor wafer is machined together with other semiconductor wafers using a set of carriers in which a mean thickness of the carrier bodies varies by no more than 3 μm.

6. The method of claim 1, wherein the semiconductor wafer is machined together with other semiconductor wafers using a set of carriers in which a mean thickness of the carrier bodies varies by no more than 3 μm.

* * * * *